US006625250B2

(12) United States Patent
Houge

(10) Patent No.: US 6,625,250 B2
(45) **Date of Patent: *Sep. 23, 2003**

(54) OPTICAL STRUCTURES AND METHODS FOR X-RAY APPLICATIONS

(75) Inventor: Erik Cho Houge, Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/742,855

(22) Filed: Dec. 19, 2000

(65) Prior Publication Data

US 2003/0142786 A1 Jul. 31, 2003

Related U.S. Application Data

(60) Provisional application No. 60/172,654, filed on Dec. 20, 1999.

(51) Int. Cl.[7] ..... G21K 1/06
(52) U.S. Cl. ..... 378/84; 378/70
(58) Field of Search ..... 378/71, 84, 145, 378/85, 70, 82, 147, 149, 73

(56) References Cited

U.S. PATENT DOCUMENTS

| | | | | | |
|---|---|---|---|---|---|
| 4,525,853 | A | * | 6/1985 | Keem et al. | 378/84 |
| 4,637,691 | A | | 1/1987 | Uehara et al. | 359/709 |
| 4,923,717 | A | * | 5/1990 | Gladfelter et al. | 427/252 |
| 5,004,319 | A | * | 4/1991 | Smither | 359/570 |
| 5,182,763 | A | * | 1/1993 | Iizuka et al. | 378/34 |
| 5,418,828 | A | * | 5/1995 | Carpenter | 378/71 |
| 5,579,363 | A | | 11/1996 | Ingal et al. | 378/84 |
| 5,850,425 | A | * | 12/1998 | Wilkins | 378/85 |
| 6,051,063 | A | * | 4/2000 | Tanabe et al. | 117/89 |

FOREIGN PATENT DOCUMENTS

| | | | |
|---|---|---|---|
| EP | 0699776 A1 | 3/1996 | C23C/16/26 |
| JP | 63245923 | 10/1987 | H01L/21/30 |
| JP | 02168149 | 12/1988 | G01N/23/20 |
| JP | 5060898 | 3/1993 | G21K/1/06 |

OTHER PUBLICATIONS

Microtexture Measurements of Aluminum VLSI Metallization, Barr, et al, 1995, pp. 347–351.

Texture and Secondary Extinction Measurements In AL/Ti Stratified Films by X–ray Diffraction, Tomov, et al, May 1997, 497–502.

* cited by examiner

*Primary Examiner*—Drew A. Dunn
*Assistant Examiner*—Therese Barber
(74) *Attorney, Agent, or Firm*—Ferdinand M. Romano

(57) ABSTRACT

A reflective lens with at least one curved surface formed of polycrystalline material. In an example embodiment a lens structure includes a substrate having a surface of predetermined curvature and a film formed along a surface of the substrate with multiple individual members each having at least one similar orientation relative to the portion of the substrate surface adjacent the member such that collectively the members provide predictable angles for diffraction of x-rays generated from a common source.

A system is also provided for performing an operation with x-rays. In one form of the invention the system includes a source for generating the x-rays and a polycrystalline surface region having crystal spacings suitable for reflecting a plurality of x-rays at the same Bragg angle along the region and transmitting the reflected x-rays to a reference position. An associated method includes providing x-rays to a polycrystalline surface region having crystal spacings suitable for reflecting a plurality of x-rays at the same Bragg angle along the region, transmitting the reflected x-rays to a reference position; and positioning a sample between the surface region and the reference position so that x-rays are transmitted through the sample.

15 Claims, 20 Drawing Sheets

OPTICAL STRUCTURES AND METHODS FOR X-RAY APPLICATIONS

RELATED APPLICATIONS

This is application is a conversion of provisional application Serial No. 60/172,654 filed Dec. 20, 1999 and incorporated herein by reference. This application is also related to Ser. No. 09/745,236 filed on even date herewith.

FIELD OF THE INVENTION

The present invention relates generally to X-ray focusing and, more particularly, to reflective lenses and systems which convert X rays from divergent sources into parallel or convergent radiation for a variety of applications.

BACKGROUND

Translation of X-rays from divergent sources into parallel beams and converging rays is subject to well-known limitations relating to Bragg diffraction theory. Focusing optics for x-rays have been based on Johann or Johansson methods applied to curved monolithic crystals. See, for example, Advances in X-Ray Spectroscopy, Eds. C. Bonnelle and C. Mande (Oxford, U.K., 1982). More recently, it has been shown that x-ray diffractors with doubly curved crystals can provide relatively greater throughput. For example, a spherical diffractor with a stepped surface has been designed at constant height conditions to provide a significantly greater solid angle aperture than achievable with a spherically curved crystal. See Witry et al., "Properties of curved x-ray diffractors with stepped surfaces", J. Appl. Phys., 69, pp.3886–3892, (1991) which discusses problems associated with practical manufacture of high-efficiency x-ray diffractors.

A diffractor may also be formed with a few pseudo-spherical curved dispersive elements. See Marcelli et al. "Multistepped x-ray crystal diffractor based on a pseudo-spherical geometry", SPIE Vol. 3448, July 1998. See, also, Mazuritsky et al. "A new stepped spherical x-ray diffractor for microbe analysis", SPIE Vol. 3449, July 1998. Even with these advances, formation of satisfactory lens systems for x-ray optics has been limited by the size of practical crystal surfaces and the extent to which such surfaces can be conformed to a desired curvature.

Consequently, x-ray optics have so far only provided as throughput a relatively small portion of the energy available from x-ray sources. This has rendered systems applications relatively large and inefficient. If larger amounts of x-ray energy could be transformed into parallel or convergent radiation, many potential applications of x-ray energy would become commercial realities. For example, with higher efficiencies, x-ray systems could become more portable and therefore more mobile.

SUMMARY OF THE INVENTION

In one form of the invention a reflective lens is provided with at least one curved surface formed of polycrystalline material. In an example embodiment a lens structure includes a substrate having a surface of predetermined curvature and a film formed along a surface of the substrate with multiple individual members each having at least one similar orientation relative to the portion of the substrate surface adjacent the member such that collectively the members provide predictable angles for diffraction of x-rays generated from a common source. In another embodiment a lens structure is formed with a polycrystalline film formed along a surface and having a curved plane fiber texture orientation.

In another embodiment of the invention a Bragg reflecting surface is formed by providing a substrate having a surface of predetermined curvature and forming a polycrystalline layer over the surface with the majority of individual crystalline grains having a common orientation with respect to the underlying substrate surface.

In still another embodiment of the invention a device for translating x-rays includes a polycrystalline surface region having crystal spacings suitable for reflecting a plurality of x-rays at the same Bragg angle along the region and transmitting the reflected x-rays to a reference position.

A system is also provided for performing an operation with x-rays. In one form of the invention the system includes a source for generating the x-rays and a polycrystalline surface region having crystal spacings suitable for reflecting a plurality of x-rays at the same Bragg angle along the region and transmitting the reflected x-rays to a reference position. An associated method includes providing x-rays to a polycrystalline surface region having crystal spacings suitable for reflecting a plurality of x-rays at the same Bragg angle along the region and transmitting the reflected x-rays to a reference position and positioning a sample between the surface region and the reference position so that x-rays are transmitted through the sample. In another embodiment the method includes providing x-rays to a polycrystalline surface region having crystal spacings suitable for reflecting a plurality of x-rays at the same Bragg angle along the region and transmitting the reflected x-rays to a reference position and positioning a sample at the reference position so that x-rays strike the sample.

BRIEF DESCRIPTION OF THE DRAWINGS

The invention is best understood from the following detailed description when read in conjunction with the accompanying figures, wherein.

Like numbers denote like elements throughout the figures and text. The features described in the figures are not drawn to scale.

DETAILED DESCRIPTION

Figure 1:
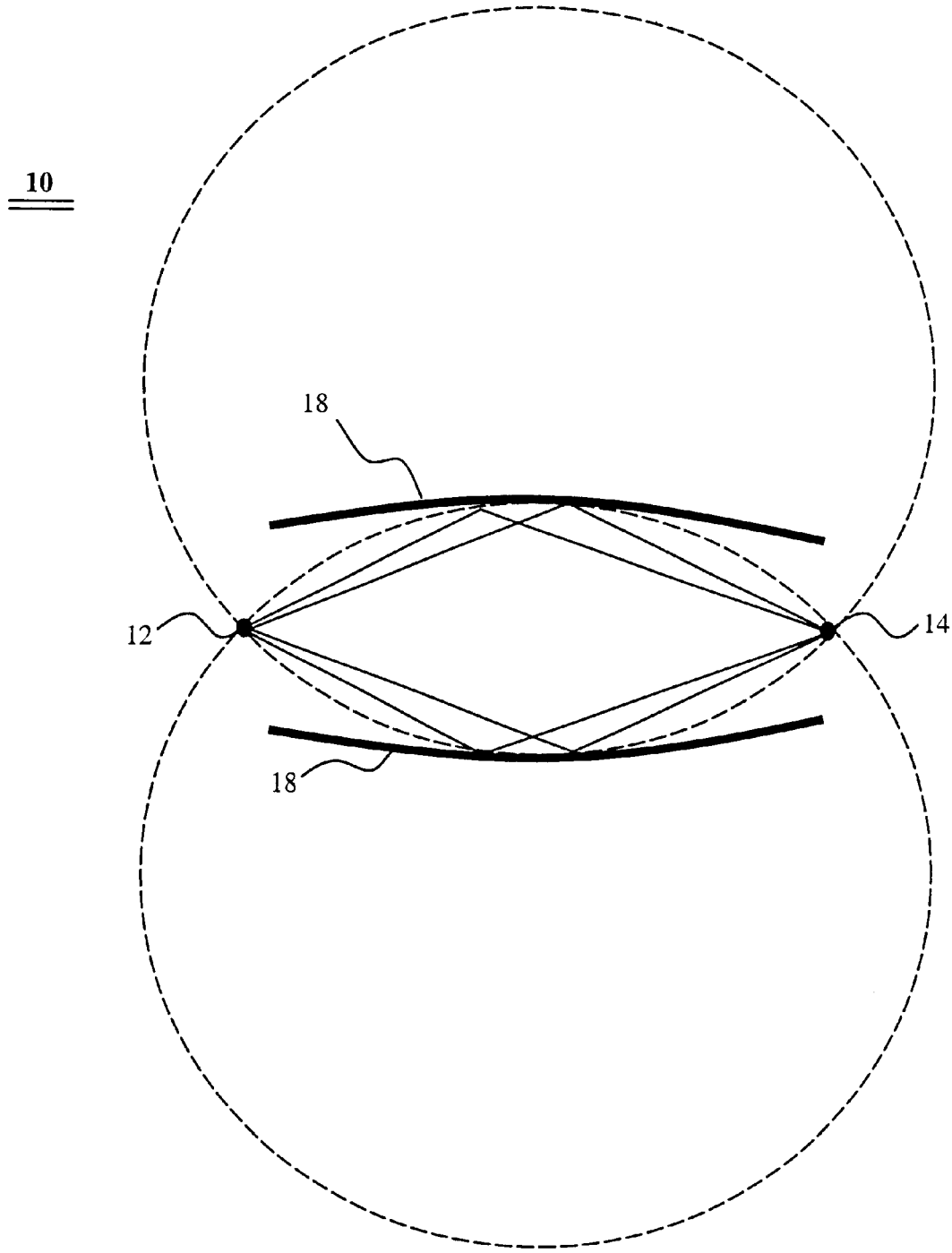
FIGS. 1–13 illustrate numerous reflective lens surfaces according to the invention.

Exemplary surface designs are illustrated in FIGS. 1 through 13 for constructing a variety of optical systems suitable for converting x-rays into parallel or converging radiation. As used herein the term parallel means substantially parallel, including degrees of parallelism satisfactory for performing the functions of systems described herein. According to the invention, polycrystalline material is formed to define a curved surface, a portion of which is positioned to reflect x-rays at or near the Bragg angle. To achieve necessary conditions for Bragg reflection many of the individual grains in the polycrystalline material exhibit a common crystal orientation.

Conventionally, a fiber texture orientation in such a polycrystalline material is understood to mean that the crystallographic direction [uvw] in most of the grains is parallel or nearly parallel to the wire axis. Fiber orientation is a measure of the degree that all of the crystalline units are oriented with a certain crystal plane normal to a reference direction. This is referred to herein as normal plane textural fiber orientation, which is to be distinguished from curvature plane texture orientation, as defined below. It is now recognized that the preferred orientation of some polycrystalline films in fiber textures, with the primary x-ray reflector normal to the surface, creates the ability to make a polycrystalline lens system which both collimates or focuses an x-ray beam to a spot below the lens itself.

Deposition of certain polycrystalline films in fiber textures with their primary x-ray reflector plane normal to a reference surface provides an ability to realize Bragg reflection along a curved surface. Information from the ICDD (International Centre for Diffraction Data) database indicates that Aluminum (Al) crystallizes in a face centered cubic structure in the Fm3m(225) space group. The cell is=4.0494 with a z of 4. The primary low order reflections are the (111), (200), (220) and (311). Additional crystallographic data is available from the PDF (powder diffraction file) card. Aluminum, when exposed to copper K-alpha radiation, has specific reflections according to the Bragg condition for reflection:

$\lambda=2\ d \sin \theta$, where $\lambda$=reflection wavelength d=interatomic plane spacing $\theta$=glancing incidence angle This condition results in the following reflections and their associated relative

| # | d(A) | l(f) | h | k | l | 2-Theta |
|---|---|---|---|---|---|---|
| 1 | 2.3380 | 100 | 1 | 1 | 1 | 38.472 |
| 2 | 2.0240 | 47 | 2 | 0 | 0 | 44.738 |
| 3 | 1.4310 | 22 | 2 | 2 | 0 | 65.133 |
| 4 | 1.2210 | 24 | 3 | 1 | 1 | 78.227 |
| 5 | 1.1690 | 7 | 2 | 2 | 2 | 82.436 |
| 6 | 1.0124 | 2 | 4 | 0 | 0 | 99.078 |
| 7 | 0.9289 | 8 | 3 | 3 | 1 | 112.041 |
| 8 | 0.9055 | 8 | 4 | 2 | 0 | 116.569 |
| 9 | 0.8266 | 8 | 4 | 2 | 2 | 137.455 |

intensities l(f):

As can be seen in the table, Aluminum's strongest reflection is in the <111> direction. This orientation has then a 2-theta Angle of approximately 38.472 degrees. Aluminum is used here as an example, while this effect can also be seen in other materials which exhibit similar orientation properties normal to the sample surface.

An inverse pole figure map was constructed for Aluminum deposited onto a titanium nitride surface by chemical vapor deposition. The map allowed color shading corresponding to the automatic tiling of the unit triangle of the inverse pole figure. For this Orientation Imaging Microscope scan of aluminum, the color red was assigned to the [001] crystal direction, the color blue was assigned to blue to [111] and the color green was assigned to [101]. A particular point was then shaded in the OIM scan according to the alignment of these three directions in the crystal to the [001] direction (normal to the surface of the wafer). For the Aluminum sample the entire inverse pole figure was a shade of blue, indicating a texture whereby the [111] crystal direction is aligned with the normal direction of the surface. The fiber texture of aluminum was shown to be almost entirely on axis.

An intensity pole figure plot of the aluminum sample for the 100, 110 and 111 directions confirmed a strong fiber texture in the [111] crystal direction of approximately 2500 times random at the center of the strongest rotational reflection on the pole plot.

With this application of polycrystalline materials on curved surfaces, the invention is understood in the context of curved plane texture orientation which is now defined to mean that the polycrystalline film is such that the individual members in the film have a plane that is oriented at a certain angle with respect to an adjacent portion of the curved substrate surface. Therefore the texture orientation is with respect to the adjacent surface and not necessarily the same as that of other members which comprise the polycrystalline film. Further, curved plane fiber texture orientation is understood to mean that the crystallographic direction [uvw] in most of the grains is parallel or nearly parallel to the wire axis. Given that aluminum deposits along its strongest x-ray reflector plane in a position normal to the substrate surface, a three dimensional lens structure may be designed to provide a focal point below the lens (as needed for projection lithography) by solving the Bragg equation for multiple paths of reflections along the three dimensional lens surface.

Once this three dimensional solution is found in space, glass (a good thermal conductor with good expansion properties) can be machined to the exact angular specifications of the lens structures and then the aluminum surface deposited on top of the glass will act as the Bragg reflector for the incident x-rays. The benefit of glass as the substrate is that, as an amorphous material, all x-rays of sufficient energy to migrate through the aluminum layer will become scattered internally to the amorphous glass atomic structure. Furthermore due to the initial conditions of a divergent x-ray source (such as by using an x-ray tube as the source) that is not delimited, e.g., by a slit, a much greater portion of the overall x-ray intensity can be used with a design that incorporates one or multiple sealed tubes or rotating anode x-ray sources.

According to the invention the design of the lens structure is a three dimensional solution to the Bragg equation for the polycrystalline reflector overlaying the glass. This could form a singular lens system or a dual lens system.

Figure 2:
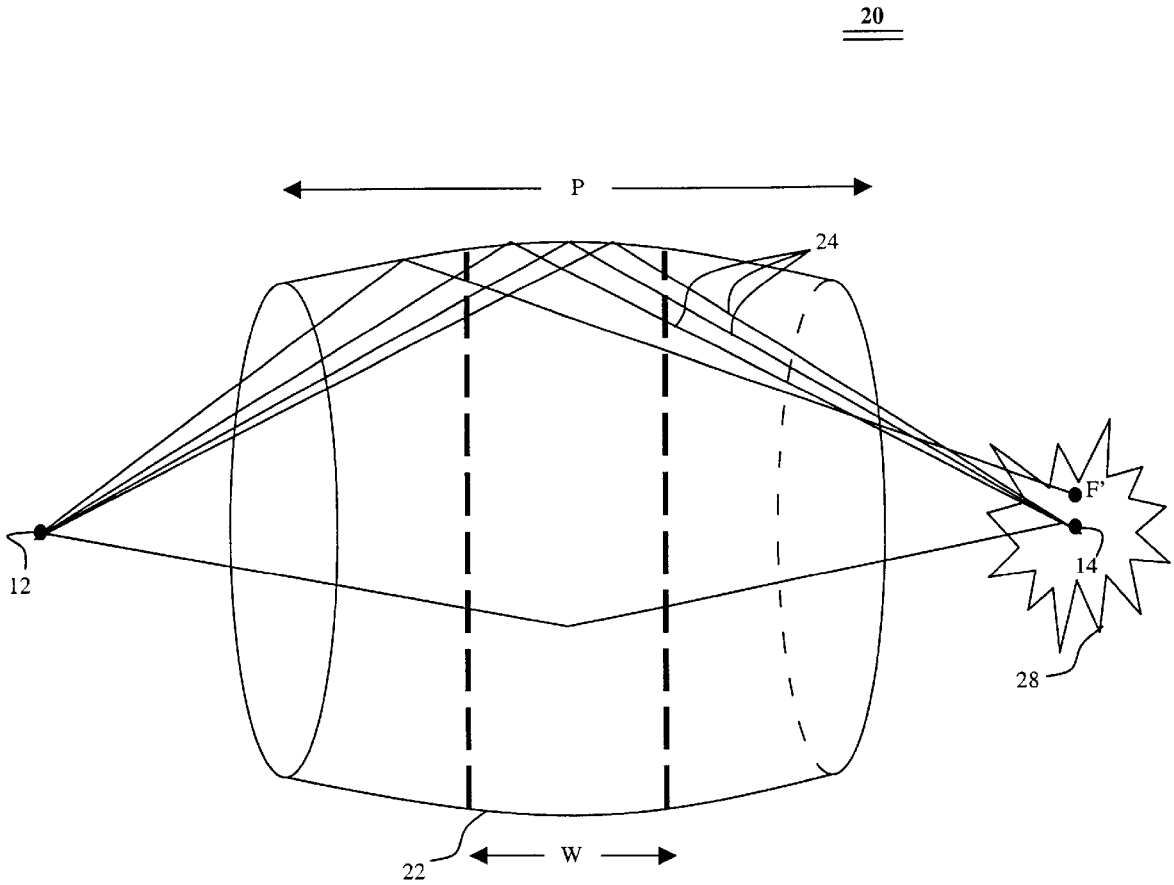
Figure 3:
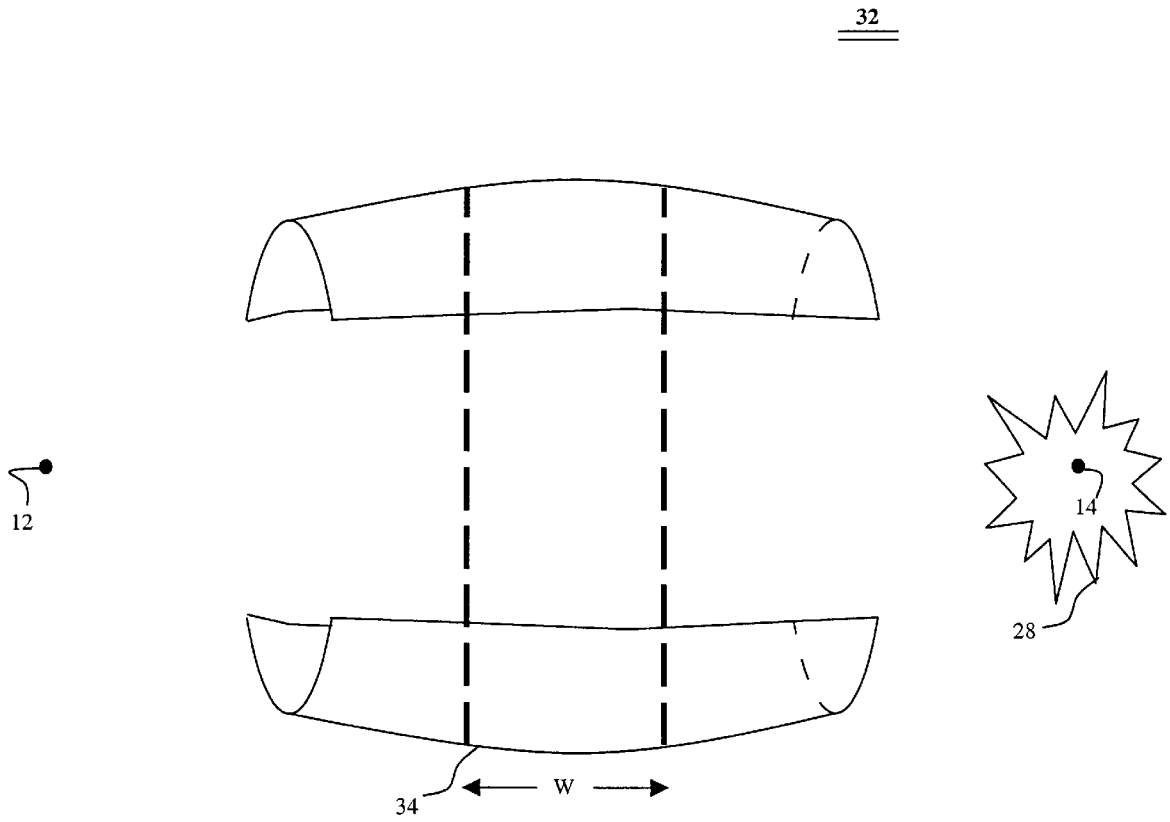

An optical system 10 for imaging with x-rays emitted from a divergent source 12 upon an ideal focal point 14 is shown in FIG. 1. The system includes a lens surface 18 which may be formed of one continuous reflective surface, or of multiple surface elements, positioned to reflect radiation impinging various regions along the surface 18 at the Bragg angle. FIG. 2 illustrates, as one example of the lens component, a full barrel-shaped surface 20, in contrast to a spaced-apart two-component surface which would exhibit inherently less throughput. With the source 12 and focal point 14 symmetrically positioned about the surface 20, a Bragg region 22 of width W along the surface 20 provides reflection of incident x-rays 24 to the focal point 14. In addition, rays 26 incident upon portions of the surface 20 near but outside the Bragg region will result in reflection of radiation within a useful focal region 28 about the focal point 14. A spaced-apart two component lens surface 32 is illustrated in FIG. 3. As described for the full barren surface 20 of FIG. 2, the two component surface 32 includes a Bragg region 34 of width W from which x-rays emanating from the source 12 are reflected to the focal point 14. The surface 32 also includes surface portions near but outside the Bragg region which reflect x-rays to a focal region 28 near the focal point 14. See, for example, F.

In each of the schematic illustrations of FIGS. 1, 2 and 3, the source 12 and focal point 14 are ideally along an axis symmetric with the curvature of the lens surface. FIG. 1 thus provides a cross sectional view along a symmetric plane, illustrating for either the full barren surface 20 or the two component lens surface 32, reflection of x-rays from the Bragg region to the focal point 14.

Figure 4:
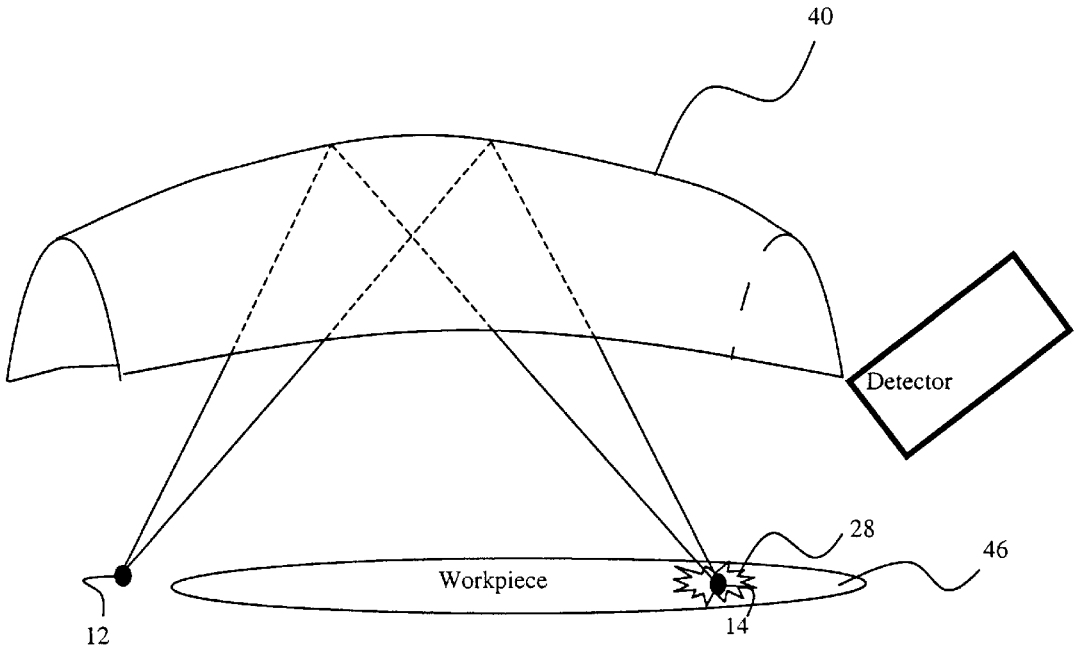
Figure 5:
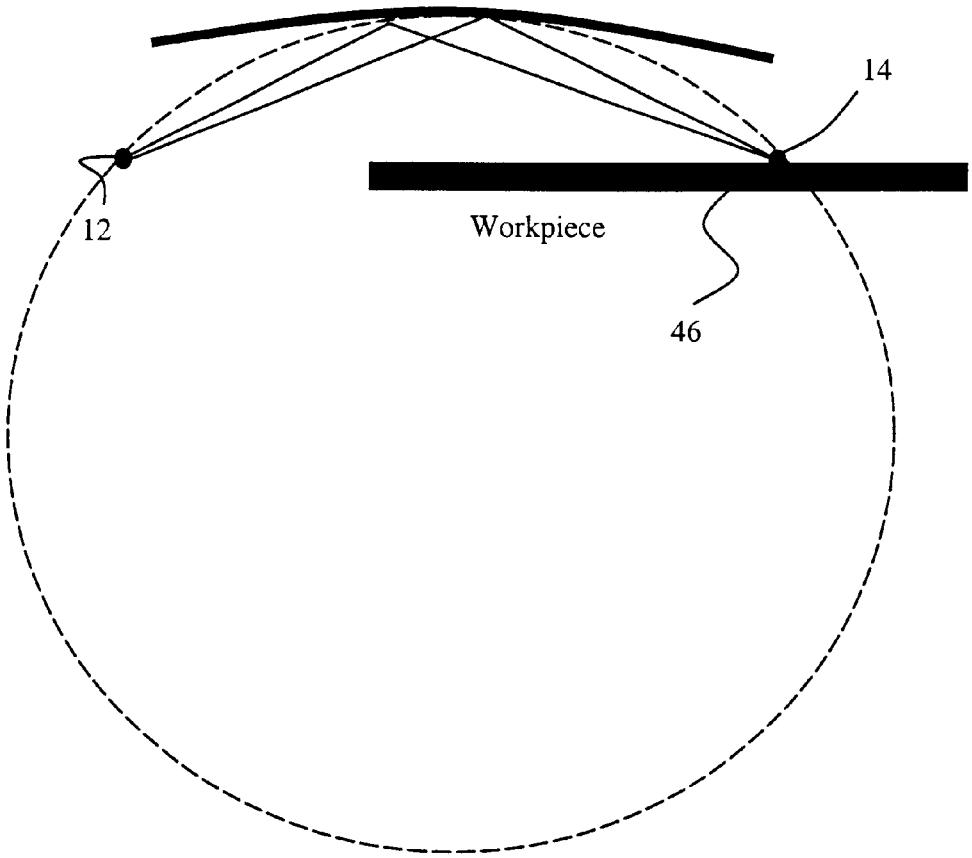
Figure 6:
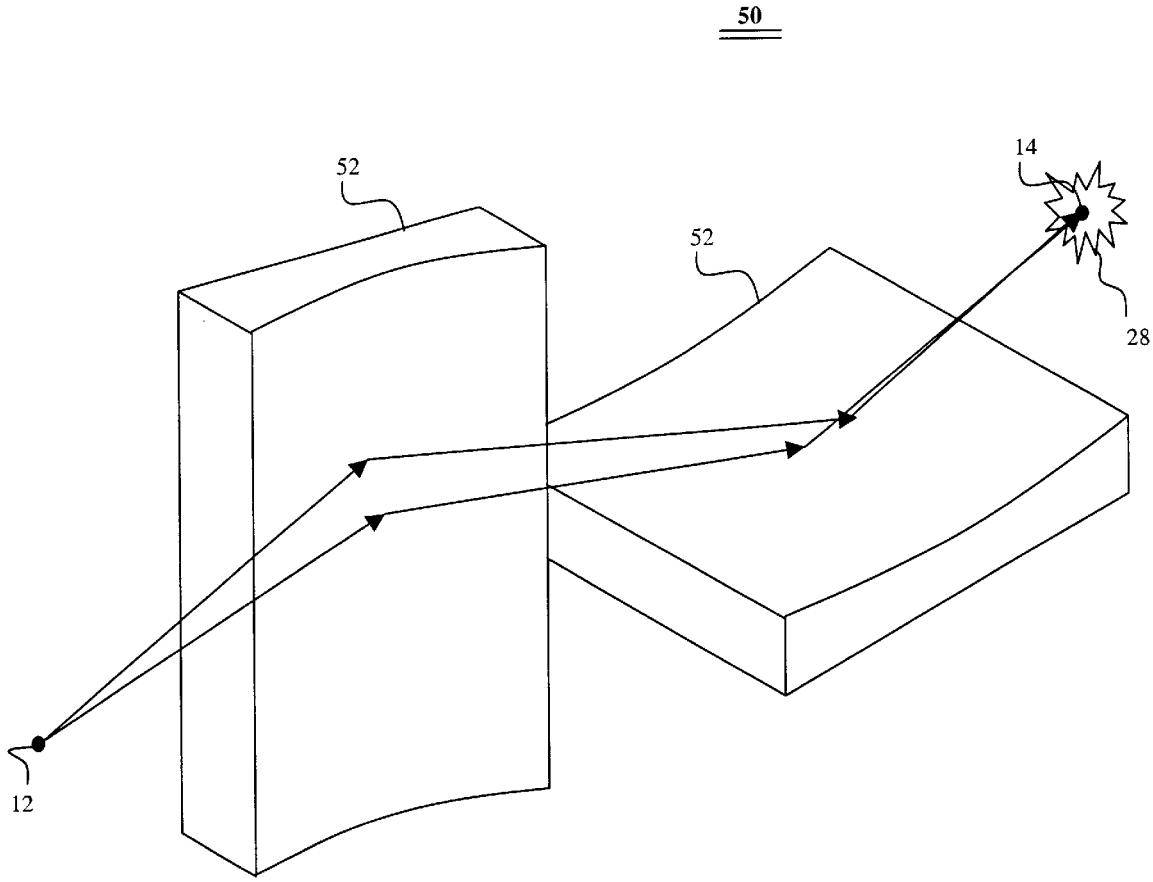

With reference to FIGS. 4 and 5, a single reflecting surface 40, comprising a series of axially symmetric partial circles, provides a suitable means for focusing the radiation about a point along a surface plane 44 of a work piece 46 such as a substrate. For example, a semiconductor wafer may be positioned along the axis defined by the source 1 and focal point 14 so that a selected portion of the surface is irradiated by x-rays reflected from the surface 40. This arrangement is beneficial for a variety of analyses , e.g., x-ray photo electron spectroscopy (XPS), and elemental spectroscopy for chemical analysis (ESCA), as well as treatments such as butt welding, cutting, and various forms of surface treatment (e.g., alloying, cladding, scribing hardening, glazing, cutting, etc.) The work piece 46 may be manipulated about the focal region 28 to effect sweeping of the x-rays along a pattern, this facilitating the various operations.

Cylindrical reflective surfaces may employ the described concepts to converge x-rays about a focal point or along a focal line. The dual lens system 50 of FIG. 6 comprises a pair of cylindrical reflector surfaces 52 as described by Cosslett, et al. "Xray Microscopy, published by the Syndics of the Cambridge University Press, (1960) at page 5, which receive x-rays from a divergent source 12 and collimates the radiation about a focal point 28, i.e., at the focal point 14 or in a limited region 28 about the focal point 28 as afore-discussed with respect to FIGS. 1, 2 and 3. This lens combination facilitates reduction of optical aberrations, e.g., astigmatism.

Figure 7:
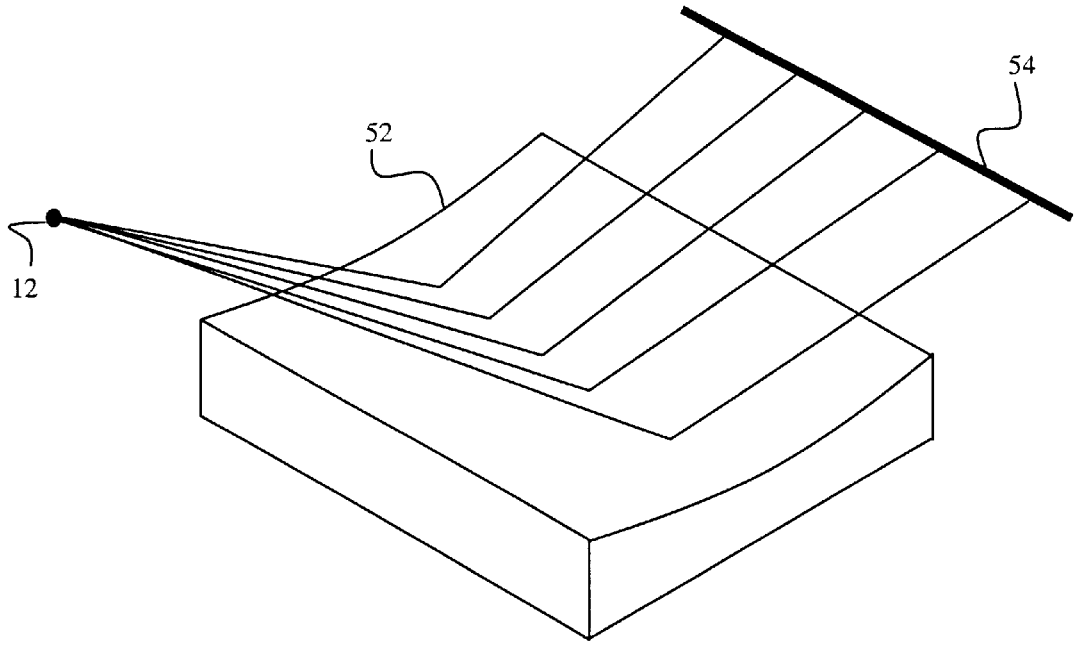

More generally, use of a single cylindrical lens surface 52, as shown in FIG. 7, enables convergence of the x-rays from the divergent source 12 along a focal line 54. Such a line 54 may be used in a scanning application for functions such as contact printing (e.g., photolithography), radiography and numerous forms of biological analyses. See again Coslett et al., at page 3.

Figure 8:
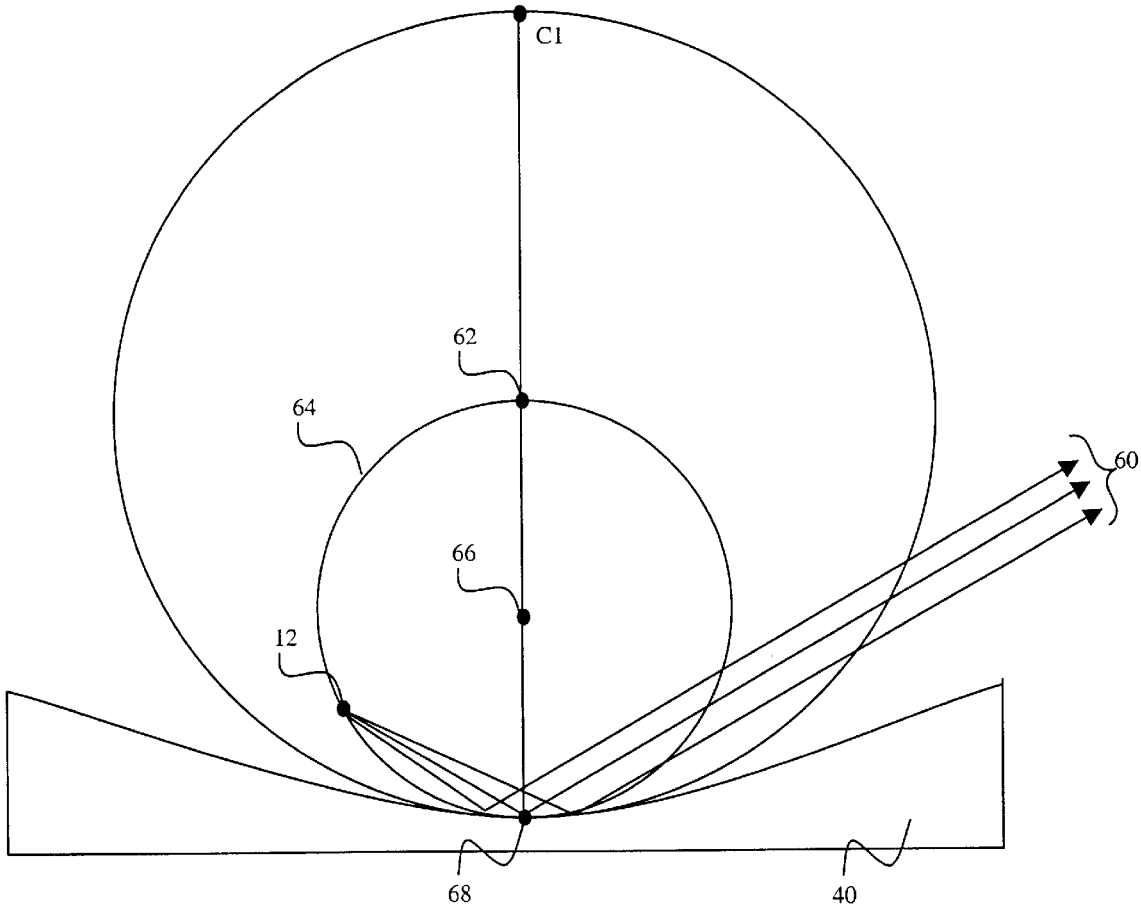

In other embodiments and applications of the invention it is desirable to generate a parallel beam of x-rays, e.g., to improve resolution of images. FIG. 8 illustrates the surface 40 of FIG. 4 applied to generate parallel x-rays 60 from a source 12 positioned along an arc having one half the radius of curvature as the Rowland circle. That is, the Rowland circle, having a center at 62, is one half the radius of curvature of the surface 40 and has a point which is tangent about the Bragg region. Thus, the source is placed along a circle 64, having a center at 66. The circle 64 includes a point 68 tangent about the corresponding Bragg region of the surface 40, and has a radius of curvature one fourth that of the surface 40. The reflected x-rays 60 are substantially parallel to one another, and may be expected to deviate from perfect parallelism based on, for example, possible misalignments such as orientation and height of crystal grains along the surface 40. However, with substantially parallel x-rays the resulting beam may be scanned to perform functions such as lithography.

Figure 9:
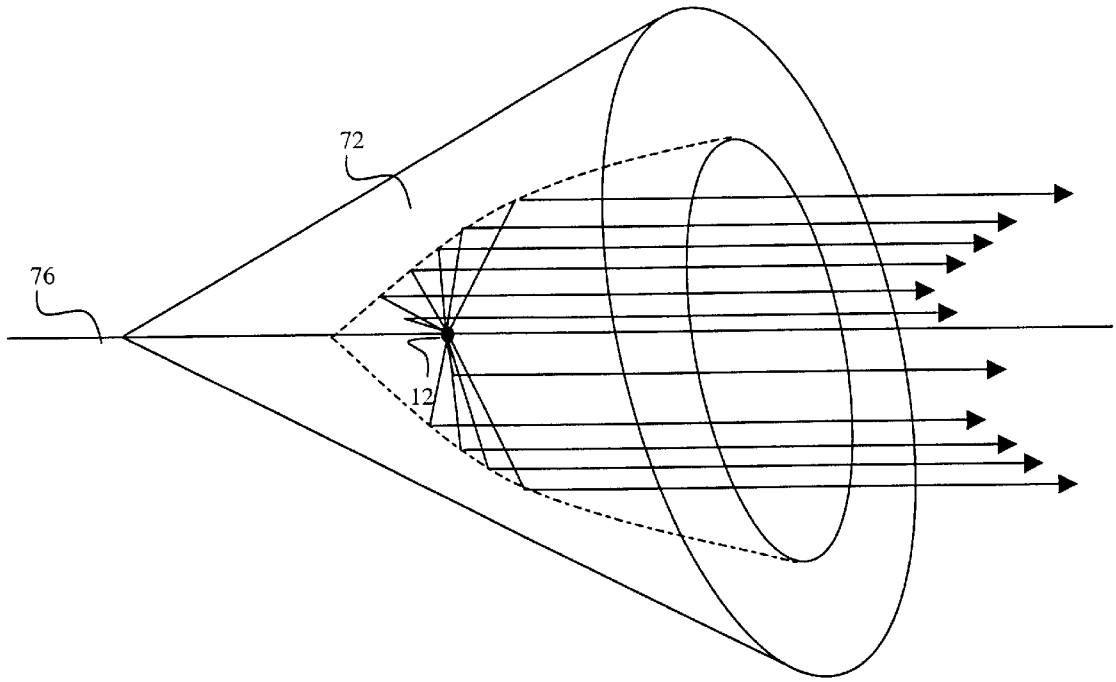
Figure 10:
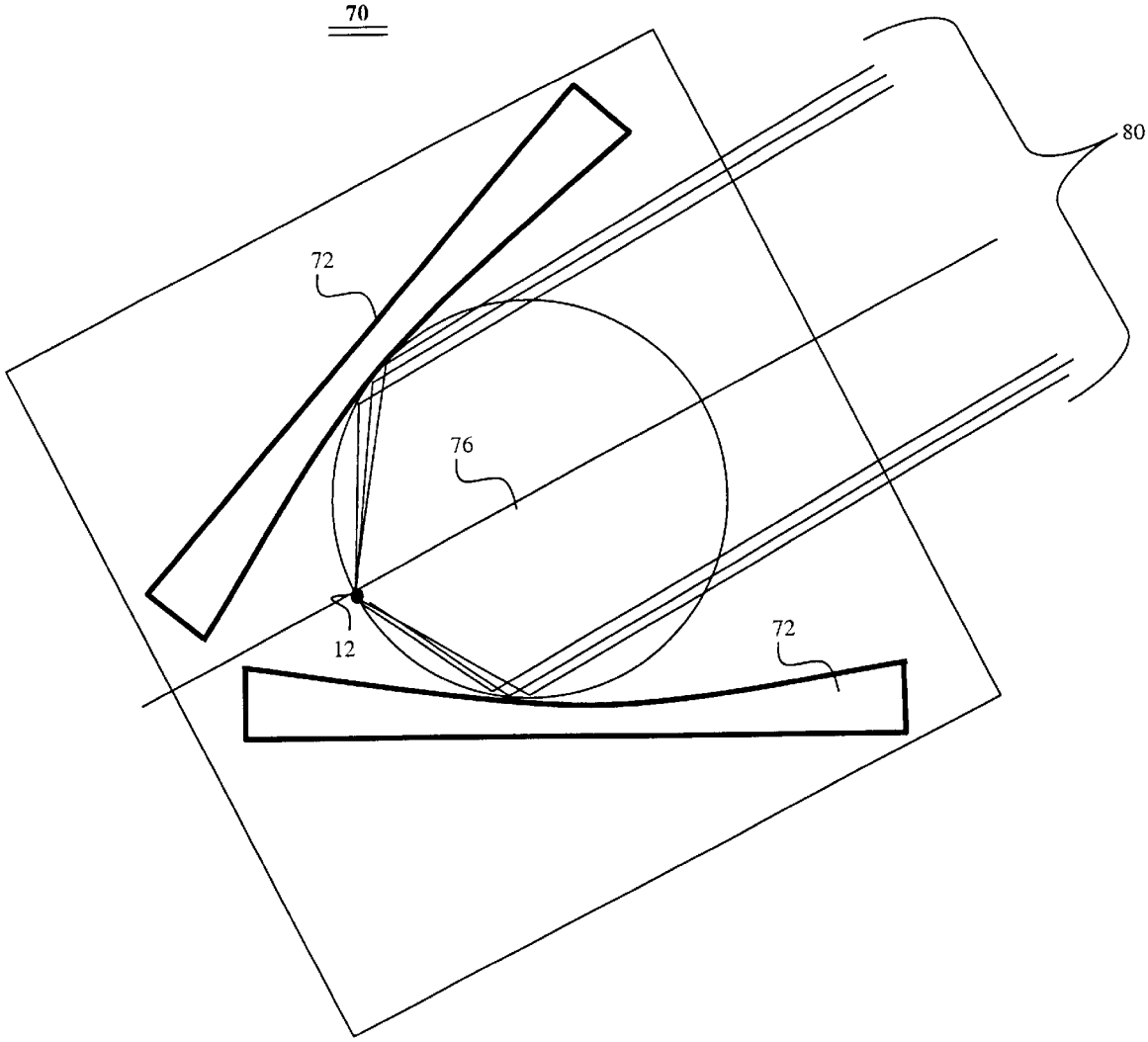

With reference to FIGS. 9 and 10, another geometric surface 70, suitable for generating parallel x-rays, corresponds to symmetric rotation of an arc of constant radius of curvature about a vertex point 72. The resulting axis 76 of symmetry passes through the vertex point 72 and the point 12 from which diverging radiation may emanate. X-rays from the point 12 undergo Bragg reflection about various portions of the surface 70 to create a parallel beam 80. Such generation of parallel rays is illustrated in the three dimensional view of FIG. 9, while the two dimensional view of FIG. 10 illustrates, for clarity, the same arrangement along a symmetric plane of the lens surface 70.

It is noted that a similar effect can be achieved with multiple lens segments which, when assembled together, may comprise a sufficient portion of the geometric surface 70 as to provide satisfactory throughput. The geometric surface 70 of FIGS. 9 and 10 provides more throughput of reflected x-rays than does the surface 40 of FIG. 8.

Moreover, the surface 40 is useful for constructing a telescope. That is, parallel x-ray radiation, e.g., from a distant source, may impinge upon the surface 70, undergo Bragg diffraction and converge upon or about the point 12. Theoretically such convergence can produce an image along a focal plane passing through the point 12. The quality of a diffraction limited image will depend, in part, on the orientation and height of adjoining crystal grains along the surface 70.

Generally, x-ray lenses constructed with polycrystalline surfaces suitable for Bragg reflection may be constructed according to the Johannson symmetrical arrangement or the Guinier assymetrical arrangement. See Peiser, et al. published by the London Institute of Physics (1955) at page 130. Such geometries enlarge the effective area of agreement between the Rowland circle and the mirror surface. Thus, throughput at and about the focal point may be substantially increased. See, for example the reflective lens surface 100 of FIG. 11 wherein a portion 102 of the reflective surface corresponds to the Johann geometry and an adjoining portion 104 includes a radius of curvature coincident with the Rowland circle 106. This arrangement provides an increased surface area over which reflected x rays will traverse the same path length between the source 112 and focal point 114. An additional requirement for maximizing the throughput of this geometry is that of maintaining reflection at the Bragg angle over the entire surface portion. That is, throughput of the lens is dependent upon establishing an orientation of the individual polycrystalline surfaces which is normal to the original Johann curvature.

While the foregoing geometries are generally difficult or impossible to achieve with a monocrystalline structure, all of the designs illustrated or contemplated can be constructed with a polycrytalline Bragg reflecting surface as afore-described. This includes but is not limited to the many complex shapes that are known to have desirable imaging properties but which heretofore have not been manufacturable or which have been fabricated with limited throughput. See, for example, Coslett et al. at pages 113, 114. All of the foregoing may be fabricated according to the invention by replacing conventional monocrystalline structures with polycrystalline materials formed along substrate surfaces of desired shapes. Another feature of the polycrystalline systems is that they may be scaled to a broad range of dimensions without the limitations associated with conventional crystals.

Figure 12:
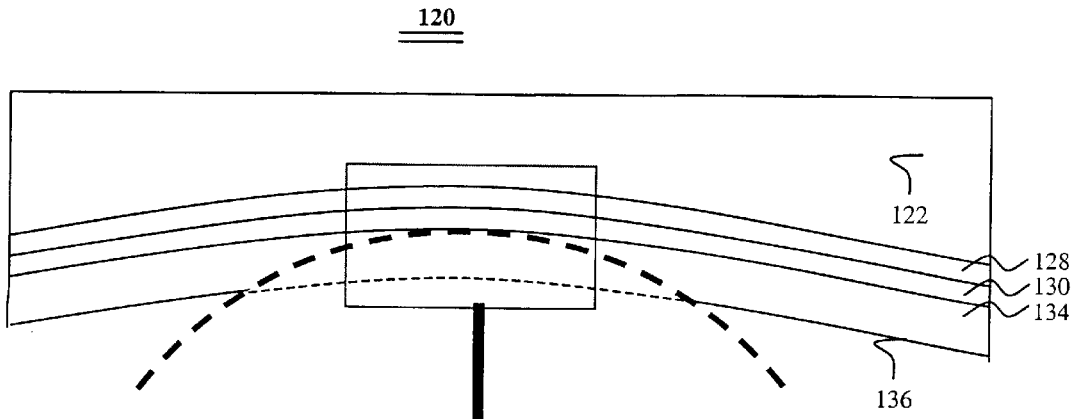

Generally, with reference to FIG. 12, such a polycrystalline lens 120 is fabricated by initially forming a substrate surface 122, e.g., glass, to provide a surface 124 having curvature consistent with the Johann geometry or other complex shapes associated with differing lens designs. A polycrystalline metal film stack 124 is formed along the surface 124. As noted herein, an exemplary material suitable for Bragg reflection is Al. Accordingly, an initial layer 128 of Ti (e.g., 37.5 nm +/−3.5 nm) is deposited, followed by a deposition of TiN layer 130 (60 nm +/−5 nm). The TiN layer 130 facilitates formation of fiber texture in the Al layer, which is deposited to a desired thickness (e.g., 450 nm or more). Alternately, amorphous metal, e.g., Al, may be formed on the layer 130 and annealed to achieve desired fiber texture. The deposition conditions are conventional. For example, the Ti may be deposited at 150 C, the TiN may be deposited at 250 C and the Al may be deposited at 300 C.

Figure 11:
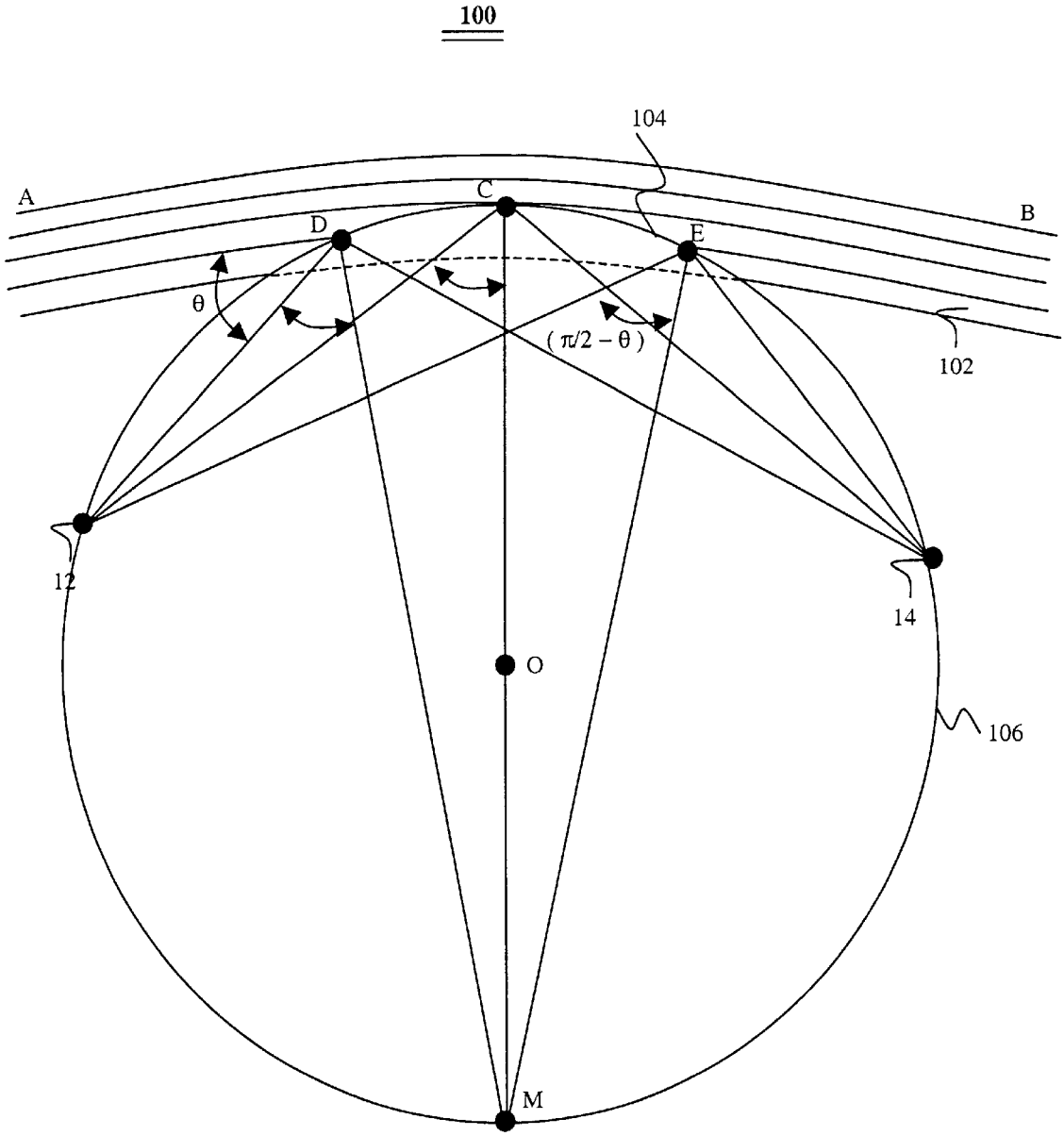

To effect a Johannson geometry, such as described for the lens surface 100 of FIG. 11, a layer 134 the polycrystalline material is first deposited to a desired thickness and a portion of the exposed metal surface 136 is then modified to provide desired curvature. This can be accomplished with conventional lens grinding techniques under thermally controlled conditions to minimize heating. To assure minimal heat generation the grinding may be performed at low rpm and may incorporate cooling techniques. The result will be removal of surface material without allowing substantial crystalline changes to occur, e.g., without alteration of grain structures or changes in grain orientations relative to the Johann surface. It is also noteworthy that the desired thickness of the lens design may be so great that a single deposition of the metal may not retain consistent orientation. That is, as the metal deposits, the fiber texture may transition to a more random orientation. To avoid this potential effect the film may be a stack created by repeated sequential depositions with an intervening amorphous material interposed between.

Figure 13:
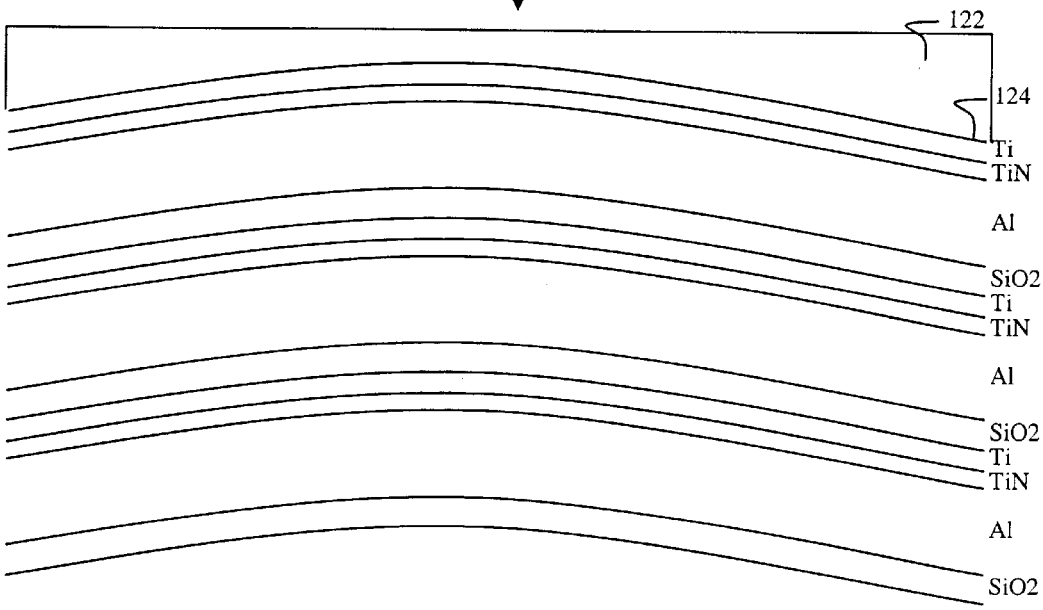

For example, after the initial layers of Ti, TiN and Al are deposited, a minimal layer 140 of silicon dioxide is deposited thereover, followed by repeated deposition of the stack comprising layers of Ti, TiN and Al. Deposition of a silicon dioxide layer 140 is repeated between subsequent metal stacks. An exemplary structure is shown in FIG. 13 wherein like numerals reference layers of like materials as set forth in FIG. 12. Other amporphous materials may be used as materials intervening between the metal stacks.

With a wide variety of lens designs now available for Bragg diffraction about polycrystalline surfaces (including those described in FIGS. 1 through 11), a variety of x-ray systems may be assembled to provide useful functions. These systems applications span multiple fields of interest. Examples include mass storage, medical and non-medical use of parallel x-rays for shadow imaging of surfaces such as bones and density variations in solid media, radiation therapy, butt welding such as applicable to sheet metal fabrication, numerous analyses in the sciences of materials, molecular biology, crystallography and astronomy, lithography, x-ray lasers and laser targets, microscopy, formation of thin films, surface treatments such as formation of hardened materials or formation of thin oxide layers to inhibit corrosion of underlying material, or treatments that alter surface properties to improve mechanical properties. Other applications include application of heat treatments, alloying, surface cladding, machining, texturing, non-contact bending and plating. From the following examples methods of applying the principles set forth to these and other systems applications will be apparent.

Figure 14:
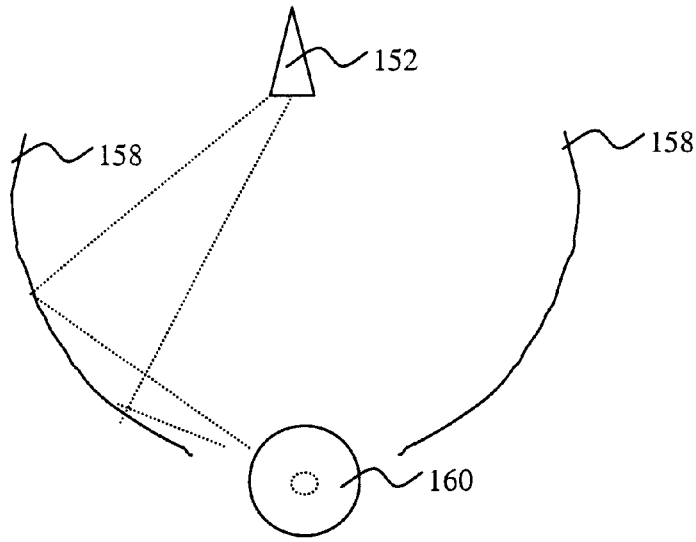
FIGS. 14–21 illustrate systems constructed according to the invention.

Generally, the design of each lens structure is a three dimensional solution to the Bragg equation for the polycrystalline reflective surface 124 overlaying the substrate surface 122. Accordingly, systems applications may be formed with a single lens or a multiple lens system. As one example, a multiple lens assembly is illustrated in the plan view of FIG. 14 and the elevation view of FIG. 15 in a photolithographic system 150 suitable for fabrication of small geometry semiconductor products. The lens combination is designed to transmit x-rays from a divergent source 152 through two Bragg reflections toward a theoretical focal point 154.

X-rays emitted from the source 152 are reflected by a first pair of lenses 158 and directed to a secondary lens 160. The first lenses are proportioned to capture a large flux of the x-rays generated from the source 152. The secondary lens 160 converges the reflected x-rays toward the focal point 154. The secondary lens 160 has a conical-like shape. The sizes and shapes and positions of the lenses 158 and 160 are based on a theoretical solution of the Bragg equation which focuses the x-rays. Once the angles for multiple reflections are calculated, different lens shapes may be determined. As described above, the lenses are formed on a substrate material having good thermal and mechanical stability.

Figure 15:
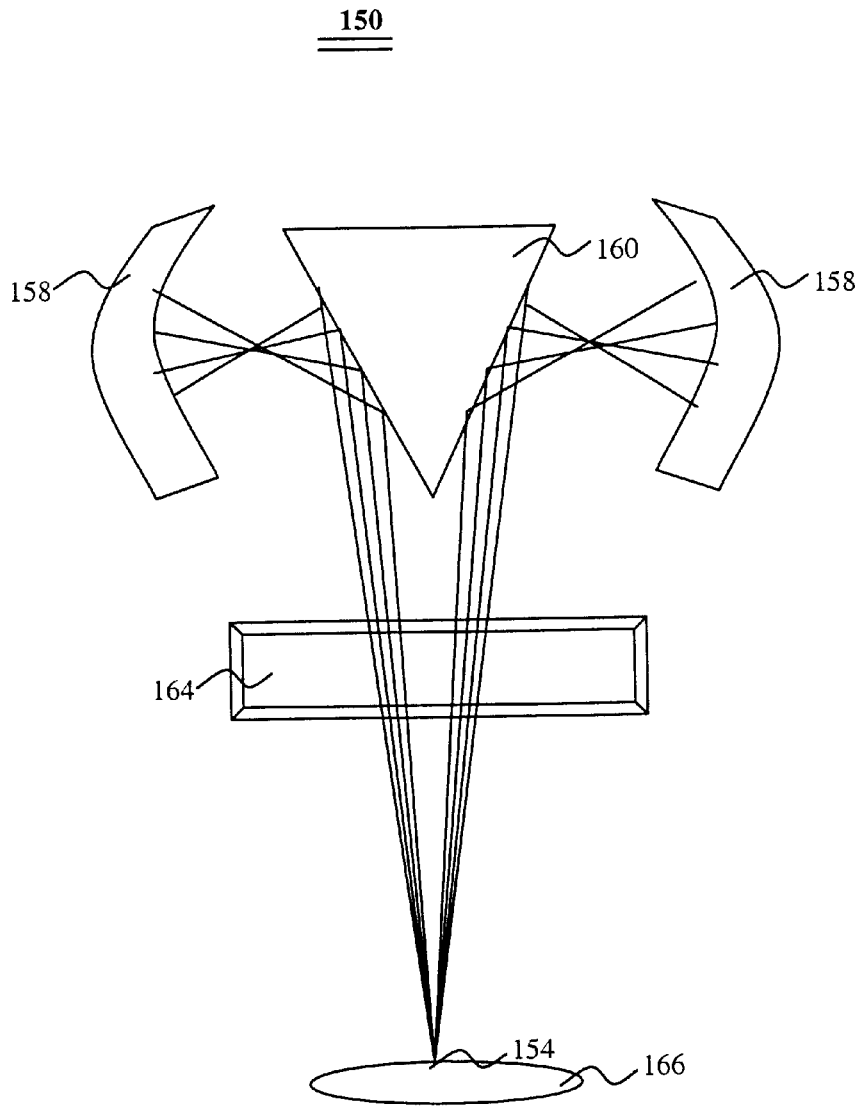

As illustrated in FIG. 15 a mask 164 containing an image and a substrate 166 are placed between the lens 160 and the focal point 154 so that collimating radiation passes through the mask to project an image of reduced size on to the substrate. The shape and focusing ability of the dual lens design allows for the resolution to be well below the limits of current x-ray lithography techniques using 1× masks and eliminates the need to produce 1× masks.

With provision of a high throughput of x-rays, relative to the total flux generated from the source, relatively small x-ray sources may perform functions such as those provided with other types of optical sources such as LED lasers. Further, the ability to focus an x-ray beam enables formation of a narrow beam width capable of high-density storage such as achievable with laser read-write technology applied to optical media such as CD ROMs. Use of x-rays to read and write data also enables three-dimensional storage of information since x-rays easily pass through most media. That is, by defining multiple focal planes in a storage medium, information can be stored in stacked layers.

By way of example, x-ray optics could generate Write Once Optical Storage in a manner analogous to CD ROM technology. The storage medium may consist of an absorptive thin metal layer, e.g., tellurium (Te) formed between two protective layers of plastic or glass with an air gap to allow for the displacement of material during the write step. Another embodiment comprises multiple absorptive metallic layers separated by layers of $SiO_2$ similar to a thin film stack on a semiconductor.

Figure 16:
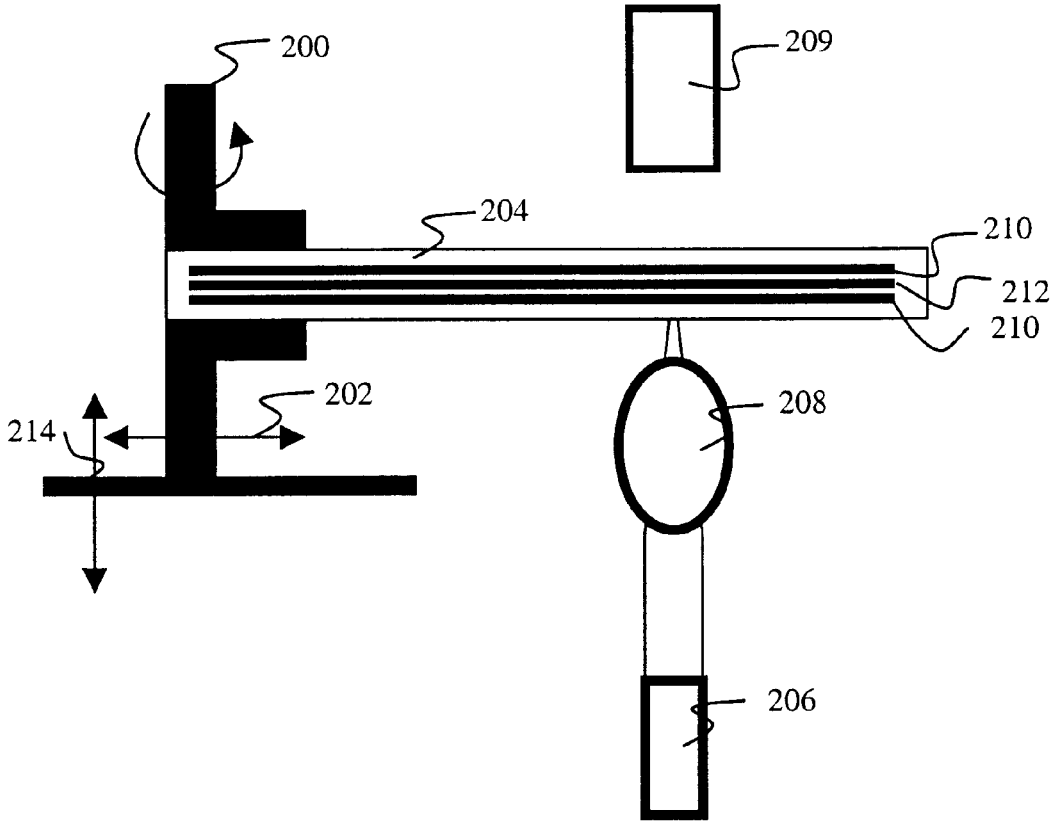

Such a system for storing information, illustrated in FIG. 16, may include a circularly rotating "axis" 200, a horizontal translation component 202, a vertical translation component 214, a storage disk 204, an x-ray source 206, focusing optics 208 and a detector 209 for sensing intensity of radiation transmitted through the disk 204. The disk may be rotated and linearly translated in a conventional manner to progressively pass discrete data locations through the radiation transmitted from the focusing optics.

For high-density storage the translation component may displace the disk 204 along three orthogonal axes. The disk 204 will then comprise sequentially alternating 25 films of metal and insulator, each metal layer providing a level for storage of different information. In this example a Te layer 210 is alternately formed with a silicon dioxide layer 212. The process for writing information at any level of metal can be effected by providing sufficient intensity at each storage location to cause localized physical transformation which affects the intensity of transmitted x-rays during a read operation. Preferably, for a multi-layer storage disk, the radiation used to write data comes from two different sources to avoid incidental deformation of the storage medium at a different level. In a disk which stores information at only one level, a single focused source may perform the write operation at a first, relatively high intensity while the read operation may be performed at a lower intensity generated by the same source. For example, the focusing lens may be shifted to vary the flux transmitted for each of the two operations.

The x-ray source 206 may be a low-cost rotating anode x-ray source and the x-rays may be generated from molybdenum or copper.

Conventional medical x-ray imaging, e.g., to examine a bone for fractures, is based on use of divergent radiation. Commonly, a plate of film is positioned under the tissue to be examined. The distance from the tissue to the plate must be uniform and minimal to avoid fuzziness of the image caused by divergence of the x-rays. When the bone or other tissue cannot be aligned with the film to avoid effects of divergence, satisfactory imaging cannot be had. For example, it may not be possible to acquire a satisfactory image of a knee or elbow joint from desired views when, due to injury, the joint cannot be adjusted to a straight position.

In contrast, provision of parallel x-rays will overcome such artifact and assure a relatively sharp image when the joint is not positioned a uniform distance from the film plate. Of course, in the past it has been possible to reduce the amount of divergence from a traditional source by moving it far away from the limb, but this approach has the disadvantage of requiring long exposure times or relatively higher powers of radiation. Thus, any prior efforts to address this problem have been countered with both health and economic disadvantages. Further, the distances which the x-rays must travel in order to approximate parallel radiation must be substantially larger than typical room dimensions.

Figure 17:
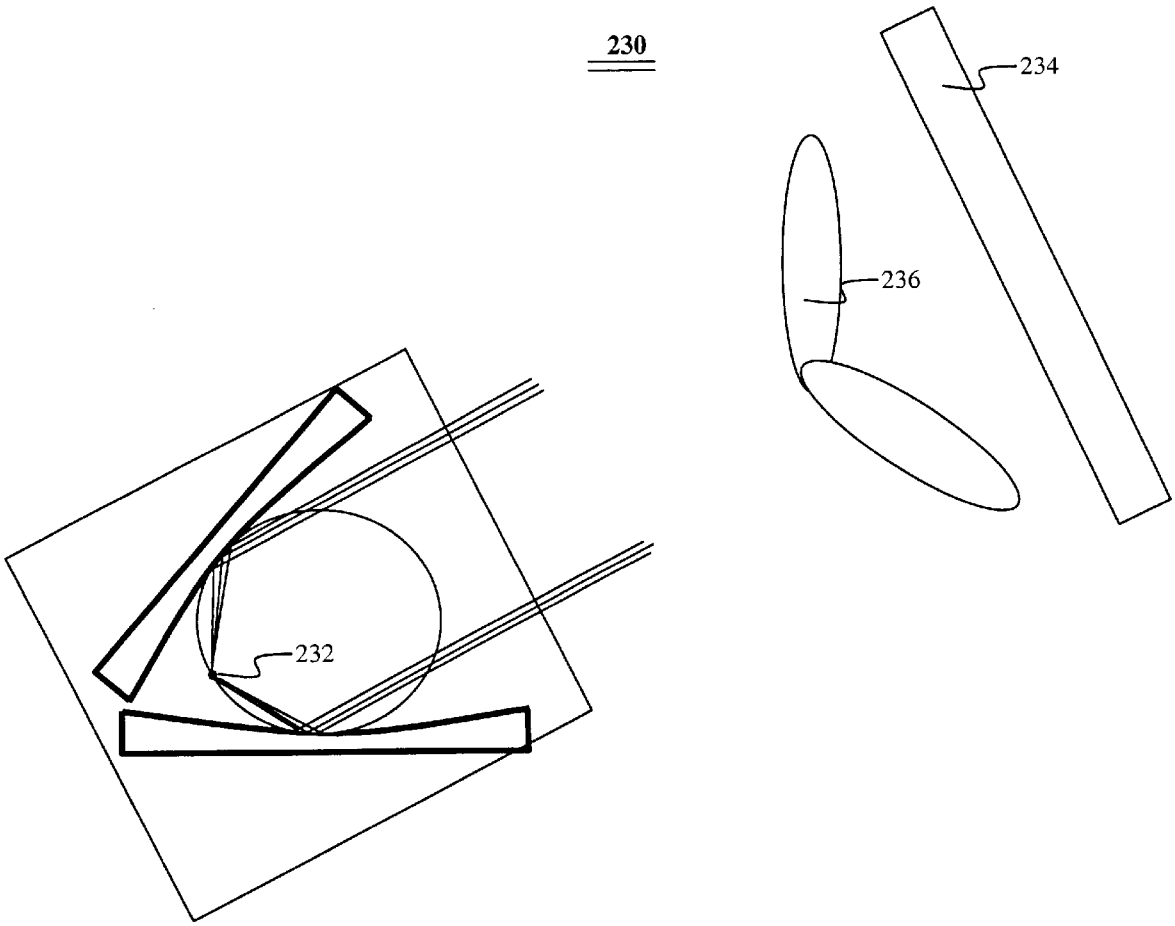

FIG. 17 illustrates in simple schematic form an x-ray imaging system 230 including a source 232 of parallel x-rays (corresponding to the source and lens arrangement of FIGS. 8, 9, and 10) and a photographic film plate 234 sufficiently spaced apart from the source 232 to permit a patient to interpose the body portion 236 of interest for examination. Similar arrangements can be constructed for non-medical applications.

Numerous medical applications of x-rays may be undertaken according to the invention. Radiation therapy, one of the oldest and most cost-effective cancer therapies requires that healthy tissue as well as cancerous tissue be subjected to high exposure levels. External beam radiation, perhaps the most widely used type of cancer radiation therapy, allows relatively large areas of the body to be treated and permits treatment of more than a localized area such as the main tumor and nearby lymph nodes. External beam radiation is usually given in periodic doses over several weeks.

Figure 18:
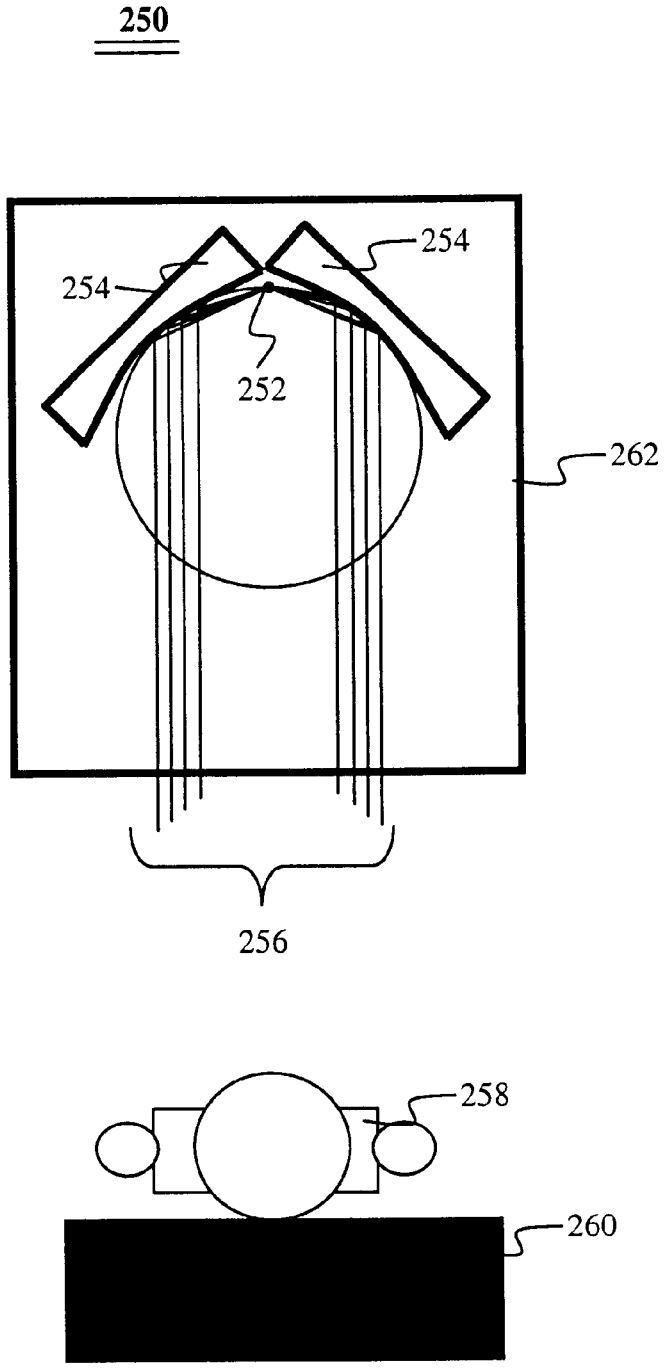

An improved system 250 for imparting x-ray cancer radiation treatments is schematically shown in FIG. 18 as comprising a divergent source 252 generating x-rays which are reflected from a lens structure 254 (such as the two lenses shown in FIGS. 8–10), projecting substantially parallel x-rays 256 upon a desired region 258 of a patient's body, e.g., positioned on a table 260. The source 252 and lens structure 254 are positioned in a suitable enclosure 262 from which the parallel x-rays emanate toward the table. The source 252 and lens structure 254 will vary substantially in size, depending on the application. For example, in order to examine a large portion of a person's body, the enclosure 262 may have to be of dimensions exceeding 4 $m^3$. On the other hand, if examination is limited to small specimens, such as a finger or tooth, the enclosure size may be less than 1 $m^3$.

Figure 19:
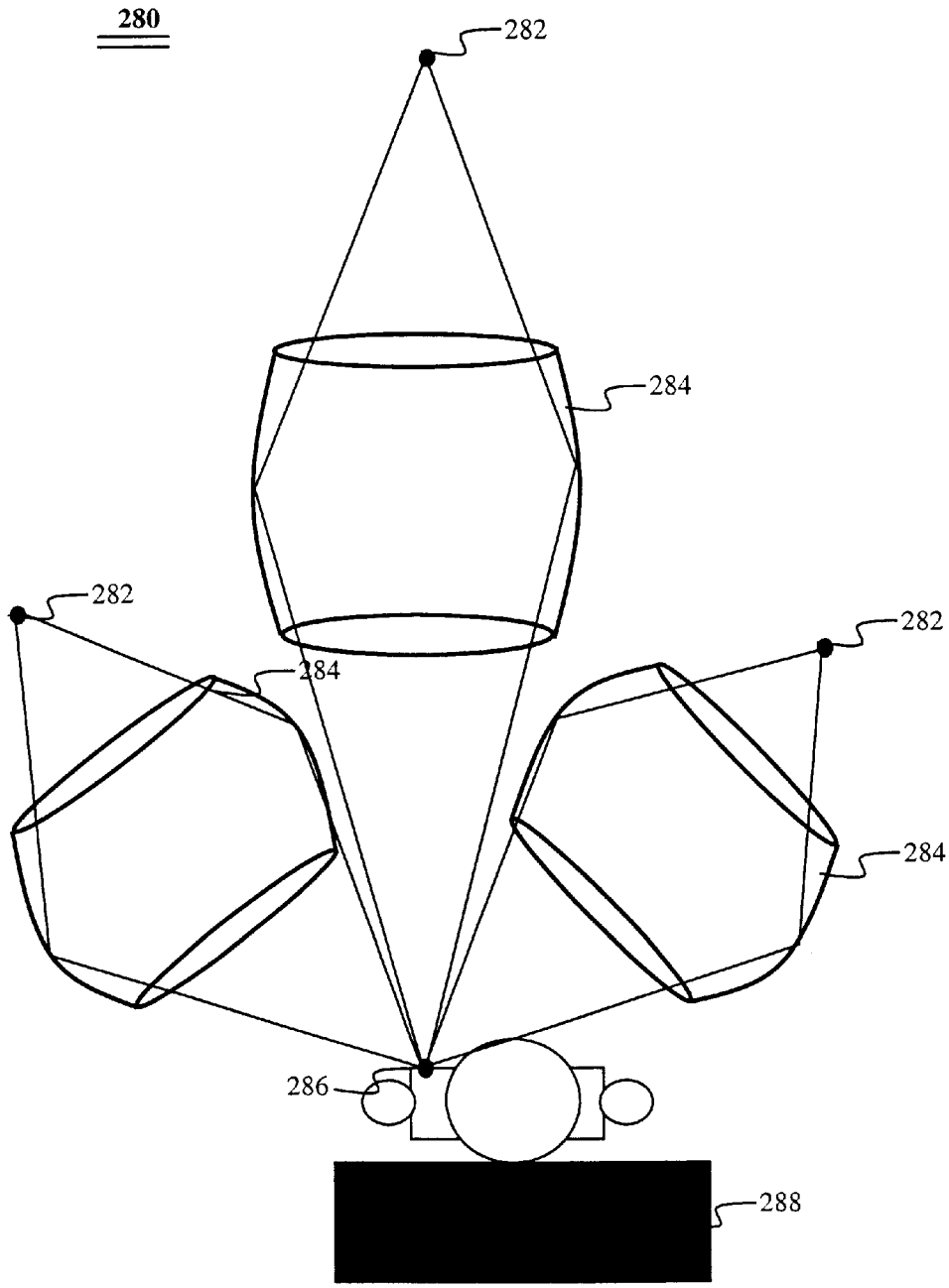

According to another embodiment of the invention, internal radiation therapy, or, brachytherapy, may be performed with the High Energy Internal Spot Beam Radiation Therapy System 280 of FIG. 19. Brachytherapy is based on interstitial radiation or intracavitary radiation. In the past, interstitial radiation has been effected by placement of the radiation source in the affected tissue in small pellets, wires, tubes, or containers. Intracavitary radiation treatment has been performed by placing a container of radioactive material in a cavity of the body. The container is placed a short distance from the affected area.

One objective of brachytherapy, delivery of a high dose of radiation within a small volume of tissue, is improved with the system 280 because the x-rays are projected from each of several sources 282 and focused via full barrel-shaped reflecting lens surfaces 284 (such as described with reference to FIGS. 1 and 2) about an irradiation volume 286. The system 280 enables delivery of a high dose of radiation within the volume 286. During operation the volume 286 includes tissue of a patient 288 undergoing treatment. Exposure of surrounding tissue is limited to tolerable, i.e., less damaging, levels.

Three sources 282 and three lens surfaces 284 are employed in the example system 280 to illustrate that a relatively high dose is created within the volume 286 while the intensity in regions outside the volume is proportionately lower than would be if all of the flux were generated from a single source. Specifically, the convergence angles based on reflection of each lens surface 284 limit the flux outside the volume 286 to low levels so as to not destroy cells, while sufficient flux is delivered within the volume 286 to perform radiation treatment.

Still another medical application of the invention may be based on one or more sources 282 and lens surfaces 284 to provide high energy and highly focused radiation in order to perform surgical procedures. Such a system may be configured as schematically described in FIG. 19 with the lens surfaces 282 adapted to narrow the focal region to a desired volume. If multiple sources are deployed, automated adjustment and alignment of the system may be effected with detector elements coupled to a feed back system and alignment mechanism.

Figure 20:
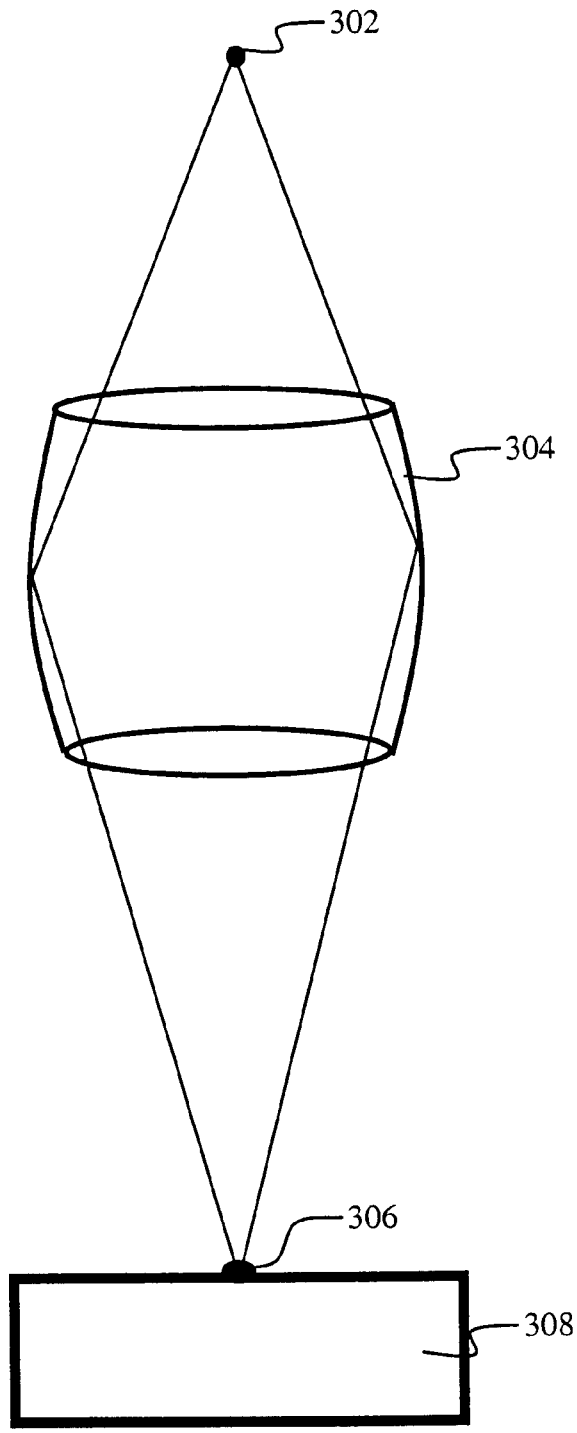

Operations of cutting, welding and other forms of surface treatment (e.g., hardening, modifying mechanical properties, melting, alloying , cladding, texturing, and machining) for industrial applications may be performed with the system 300 of FIG. 20 comprising a source 302, a barrel-shaped reflecting lens surface 304 (as described in FIGS. 1 and 2) configured to converge x-rays about a focal point 306 to perform an operation on a work piece 308. Either the focal point or the work piece may be displaced to irradiate a desired area of the work piece on or within the work piece.

Alternately, and with application to low energy operations, lens surfaces such as illustrated in FIG. 7 may be employed in lieu of the surface 304 to create a focal line to effect the surface treatment. The focal line or the work piece may be displaced to effect irradiation of a desired region on or within the work piece.

Figure 21:
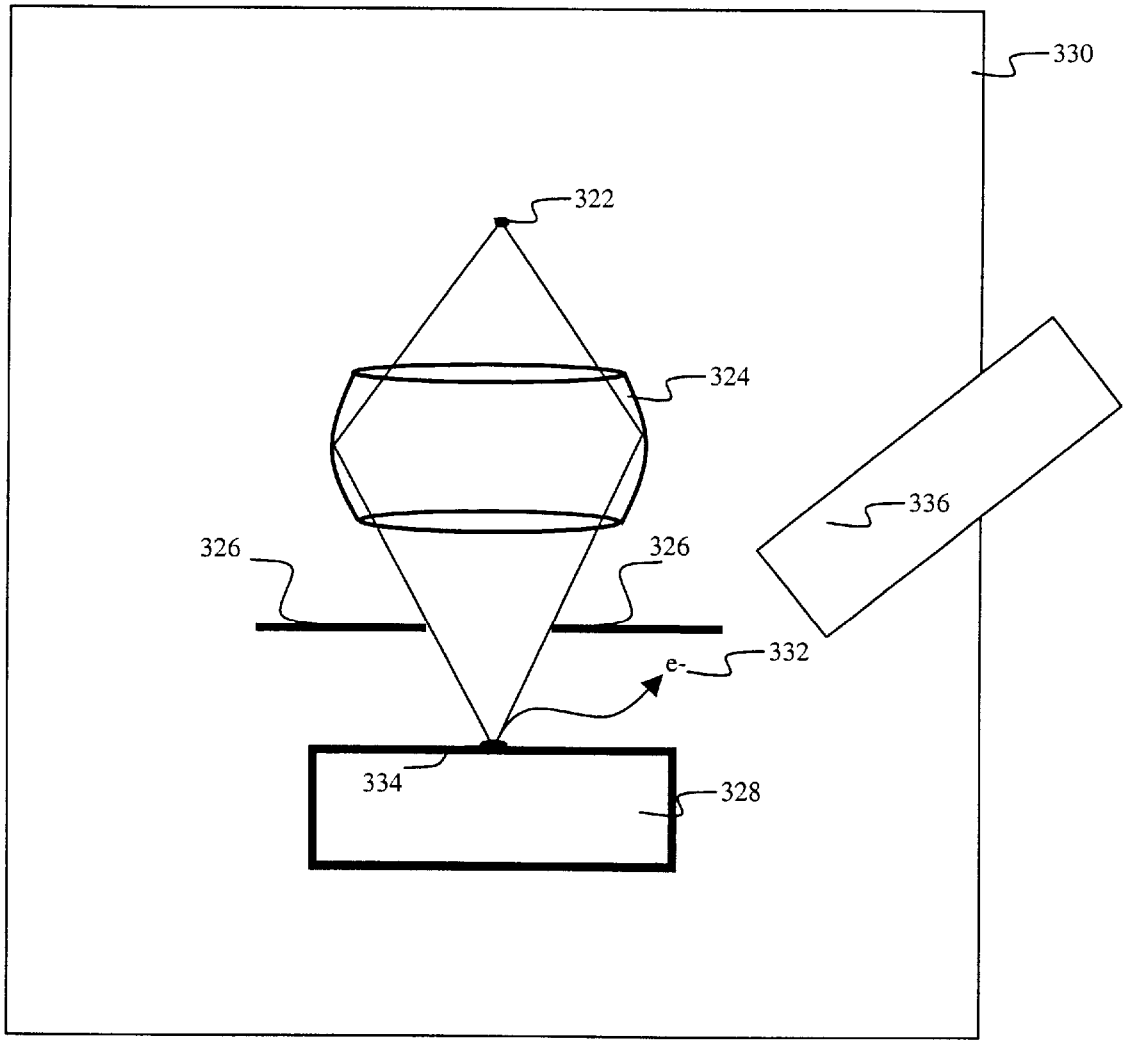

In the past x-ray photoemission spectroscopy (XPS) has been performed with unfocused x-rays, this resulting in a large beam spot. The size of the beam spot, e.g., ranging from tens of microns to millimeters in diameter, limits the spatial resolution of the technique. For XPS applications as well as other contexts in which a beam width substantially less than 10 microns is desired, converging x-rays emanating from a lens surface toward a desired focal region are passed through an aperture positioned relatively close to the focal region. Such apertures may be fabricated with focussed ion beam techniques. The exemplary XPS system 320 of FIG. 21 illustrates a source 322 which generates x-rays for reflection at a lens surface 324 to transmit converging radiation through an aperture 326 and on to a sample 328. The system 320 is positioned in a low pressure chamber 330 to detect emission of electrons 332 from about a focal region 334 by a collector 336.

Other potential systems applications for the concepts described herein include x-ray microscopy and x-ray laser mirrors. Generally it should be recognized that the source and lens combination of each system should be statically fixed to one another in order to satisfy requisite tolerances for realizing optimum Bragg diffraction along the reflective surface.

The invention has been described with exemplary embodiments while the principles disclosed herein provide a basis for practicing the invention in a variety of ways. Other constructions, although not expressly described herein, do not depart from the scope of the invention which is only to be limited by the claims which follow:

I claim:

1. A lens structure comprising: a substrate having a surface of predetermined curvature; and a film formed along a surface of the said substrate with multiple individual members each having at least one similar orientation relative to the portion of the substrate surface adjacent the member such that collectively the members provide predictable angles for diffraction of x-rays generated from a common source.

2. The lens structure of claim 1 wherein the film members each have a crystal orientation relative to an associated plane and the majority of the planes are each oriented with respect to a portion of said substrate surface adjacent the corresponding member at substantially the same angle.

3. The lens structure of claim 2 wherein the film is a polycrystalline structure comprising a plurality of grains having a fiber texture normal to the curvature of the substrate surface.

4. The lens of claim 1 wherein the film includes grains predominantly comprising Al with sufficient grains having a [111 ] direction normal to adjacent portions of the substrate surface such that the spatial distribution of the grains provides a fiber texture.

5. A reflective lens for converging x-rays comprising at least one curved surface of polycrystalline material.

6. The lens of claim 5 wherein the lens includes a reflective surface region of curvature for converging said x-rays into a beam of substantially parallel rays.

7. The lens of claim 5 wherein the lens includes a reflective surface region of curvature for converging said x-rays about a focal region.

8. A lens structure comprising:

a polycrystalline film formed along a surface and having a curved plane fiber texture orientation-suitable to Provide parallel x-rays or suitable for focusing x-rays.

9. The structure of claim 8 wherein the film comprises lattice structures suitable for Bragg reflection along a sufficient portion of the surface to focus x-rays.

10. A method for transmitting x-rays to a region comprising:

reflecting x-rays from a curved polycrystalline surface having a curved plane texture orientation based on Bragg diffraction.

11. The method of claim 10 wherein the step of reflecting the x-rays is performed about a surface curvature which converges the x-rays.

12. The method of claim 10 wherein the step of reflecting the x-rays is performed about a surface curvature which converges the x-rays into a beam of substantially parallel rays.

13. The method of claim 10 wherein the step of reflecting the x-rays is performed about a surface curvature which focuses the x-rays about a point.

14. A method for forming a Bragg reflecting surface comprising:

providing a substrate having a surface of predetermined curvature; and forming a polycrystalline layer over the surface with the majority of individual crystalline grains having a common orientation with respect to the underlying substrate surface to provide a curved plane texture orientation of the type suitable for transforming divergent x-rays into Parallel or focusing radiation.

15. A device for translating x-rays, comprising:

a polycrystalline surface region having crystal spacings suitable for reflecting a plurality of x-rays at the same Bragg angle along the region and transmitting the reflected x-rays to a reference position.

* * * * *